United States Patent [19]

Kletch

[11] 4,311,456

[45] Jan. 19, 1982

[54] BLAST FURNACE STOVE

[75] Inventor: Stanley J. Kletch, Bridgeville, Pa.

[73] Assignee: Bricmont & Associates, Inc., McMurray, Pa.

[21] Appl. No.: 170,288

[22] Filed: Jul. 18, 1980

[51] Int. Cl.[3] ..... F24H 7/00; C21B 9/00; F23D 3/40; F23D 19/00

[52] U.S. Cl. ..... 432/30; 431/7; 431/170; 432/216

[58] Field of Search ..... 432/29, 30, 214, 216; 431/7, 170

[56] References Cited

U.S. PATENT DOCUMENTS

| | | | |
|---|---|---|---|
| 1,849,657 | 3/1932 | Boynton | 432/217 |
| 3,477,701 | 11/1969 | Ando et al. | 432/217 |
| 3,627,284 | 12/1971 | Santpoort et al. | 432/217 |

*Primary Examiner*—John J. Camby

*Attorney, Agent, or Firm*—Thomas H. Murray; Clifford A. Poff

[57] ABSTRACT

A vertically-fired blast furnace stove includes a mixing bed comprised of a multitude of spheres, cylinders or berl saddles supported by a carrier having openings therein located in the bottom portion of a vertically-extending combustion chamber. The bed extends within the walls of the combustion chamber above the floor to form a chamber coupled to pipes for delivering fuel and air to pass in the inner space openings in the bed where mixing and heating of the fuel and air supplies occurs for combustion above the bed. The hot products of combustion are directed by a dome into a heat-storage chamber having a filling of checkerbrick and then into a flue pipe. A control system operates valves for the air and gas supplies to heat the combustion walls above the ignition temperature after which the supplies of fuel and air are controlled in relation to a pressure difference between the pressure in the combustion chamber above the mixing bed and the supply pressure of at least one of the combustion components comprised of fuel and air. The fuel-to-air ratio is varied to increase the dome temperature to a predetermined maximum and thereafter the combustion products are tempered by increasing the supply of air to maintain the predetermined maximum dome temperature. During this period of control, the checkerbricks in the heat-storage chamber are heated to their desired elevated temperature which is determined by monitoring the temperature of combustion gases delivered to the flue.

19 Claims, 2 Drawing Figures

BLAST FURNACE STOVE

BACKGROUND OF THE INVENTION

Figure 1:
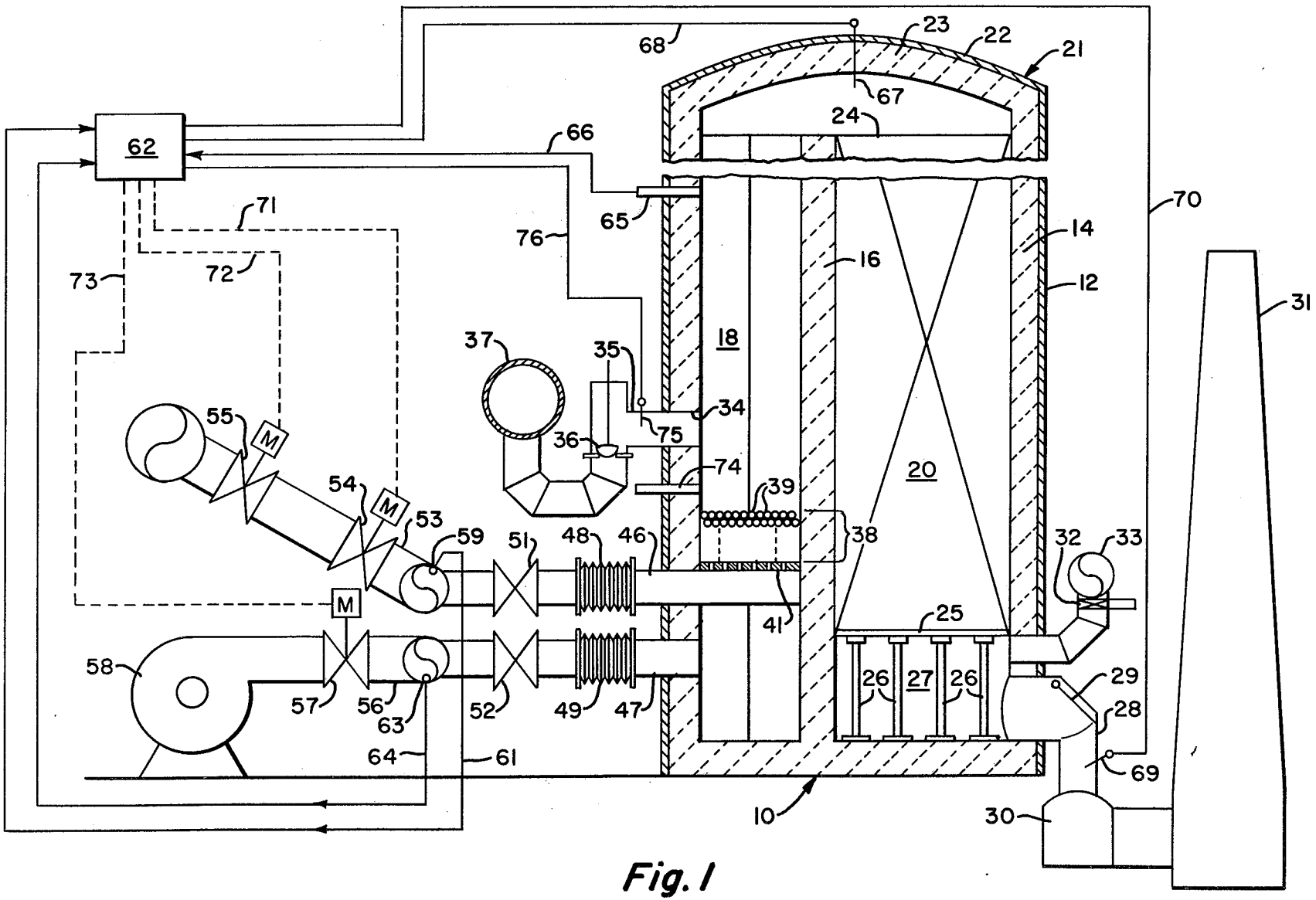

This invention relates to a blast furnace stove, although equally applicable to stoves for other purposes, of the type having a combustion chamber coupled to a burner to supply hot products of combustion to a checker-filled heat exchanger for heating an air supply. More particularly, the present invention relates to an apparatus and method of operating such a stove wherein the combustion chamber includes a mixing bed comprised of a multitude of bodies of high-temperature material on a support to mix and heat fuel and air supplies for combustion thereabove in the combustion chamber.

As is well known in the art, a plurality of blast furnace stoves is operated at time-displaced cycles to heat a blast of air used to provide heat for a blast furnace. In each stove there is a vertical combustion chamber coupled to a burner to inject gas, usually blast furnace gas, and air into the bottom portion of the chamber for combustion. The combustion products are directed by a dome from the top of the combustion chamber into a regenerator through passageways in a filling of checkerbrick to heat the blast of air. The blast of air usually flows through the openings in the checkerbrick countercurrent to the flow of combustion gases. Generally, the heated air is withdrawn through an opening in the side wall of the combustion chamber. In such a blast furnace stove, the burner is usually arranged to direct the flame horizontally into the bottom of the vertically-extending combustion chamber. A water-cooled burner valve opens and closes the passageway from the stove gas burner into the combustion chamber and provides thermal protection for the metal parts of the burner. The stove is generally comprised of a metal shell used to support a lining of refractory material. An internal refractory wall that includes a breast wall is joined to the lining of refractory material within the metal shell to form part of the actual combustion chamber and provides support for the checkerbrick in the heat-storage chamber or regenerator. More than one lining of refractory material may be used in the combustion chamber to withstand the high temperature developed therein.

The present invention is addressed to overcoming certain disadvantages to the construction and operation of known forms of blast furnace stoves. Thus, for example, the life of the refractory material is reduced in the combustion chamber at the site where the burner flame or admixed fuel and air fed from the burner impinges on the refractory wall. Repairs to the refractory material at this area and elsewhere can be usually carried out only after the stove is cooled to near ambient temperature. This requires a long interruption to the operation of the stove which seriously affects its economical operation. Moreover, direct flame impingement on the refractory of the combustion chamber brings about the development of large thermal stresses in the metal shell of the blast furnace stove. These stresses increase the need for refractory maintenance since they tend to separate the shell from the refractory, whereby voids may occur that permit hot gas to contact the shell which worsens with each cycle of operation. When a metallic burner housing is used, it must be joined by a rigid and close-coupled connection pipe that is vital and has uncompromising importance. This requires a water-cooled valve to isolate the burner from the combustion chamber. The valve is subject to mechanical failure and it is cumbersome, but nevertheless essential in most blast furnace stoves to isolate the burner from the combustion chamber, particularly during the time when the blast of air is fed into the stove for heating. The wall opening in the refractory for the fuel and air from the burner is normally situated below the opening in the combustion chamber used to discharge the blast of heated air from the stove. During this period of stove operation, radiant heating occurs in the combustion chamber which places stringent requirements for thermal isolation of the burner from the combustion chamber. A water-cooled valve is also necessary to isolate the burner from the combustion chamber because of the pressure of the blast air which is typically between 30 and 50 psig.

In a further aspect, when an external burner is used for a blast furnace stove, the burner structure forms a space where dangerous quantities of fuel gas may collect should a leakage occur in a gas shutoff valve. Such a gas leak is not an uncommon occurrence and it permits an accumulation of gas that may extend into the burner combustion air-supply pipe for the burner and the air blower. The gas can pass in this manner to the surrounding outside area and, therefore, presents a hazard to operating personnel due to gas inhalation, fire and explosion.

In U.S. Pat. No. 3,779,690, there is disclosed a gaseous mixing device for a blast furnace stove to meet the need for a higher temperature air blast (1200° C. to 1300° C.) in which a refractory burner is used in a combustion chamber. The mixing device is designed from refractory material to form a horizontal chamber arranged to impart a swirling or rotational movement to mix air and combustible gas at the bottom of the combustion chamber. Channels tangentially intersect with a mixing chamber having a conical throat at its upper end to move the gases inwardly toward the center for combustion above the throat in the combustion chamber. This system, while eliminating the traditional metallic burner, places stringent requirements for the refractory material in the stove. Particulate material carried with the fuel and air supply has a detrimental effect on the refractory material which can pass into the checkerbrick in the heat-storage chamber and reduce the gas flow space, thereby increasing the pressure drop. Moreover, the refractory material forming the mixing device is subject to severe radiant heating during an air-heating cycle of operation. The present invention is addressed to an improved construction and method of operating a blast furnace stove. It includes a mixing bed in a combustion chamber thereof to mix and heat fuel and air supplies for combustion thereabove.

SUMMARY OF THE INVENTION

It is an object of the present invention to provide a combustion system that is particularly unique for use in a blast furnace stove to simplify and improve control of the stove with less hazard than presently existing with known forms of stove constructions.

It is a further object of the present invention to provide a combustion system for an air heater particularly adapted for use in a blast furnace stove that does not suffer from the shortcomings arising out of the use of metallic burners and associated structure required for operation under high-temperature conditions.

More specifically, according to the present invention there is provided a vertically-fired blast furnace stove comprising a vertically-extending combustion chamber having an exhaust opening for discharging heated air, heat-storage means to receive the products of combustion from the vertically-extending combustion chamber, air-supply means communicating with the heat-storage means for discharging heated air therefrom to the exhaust opening, a mixing bed comprised of a multitude of bodies upon a carrier in the combustion chamber to mix and heat fuel and air supplies for combustion thereabove, and means including control valves to introduce fuel and air into the mixing bed for rapid combustion thereabove in the combustion chamber. The present invention provides a method for controlling such a blast furnace stove wherein the fuel and air are passed through the mixing bed at the bottom portion of the combustion chamber, the supplies of fuel and air are increased with increases to the temperature of a dome that is heated by the combustion gases and located above the combustion chamber to direct the gases to the heat-storage means. Such increases to the fuel and air are carried out to heat the combustion chamber above the ignition temperature of the fuel and air up to a predetermined minimum temperature, and thereafter the supplies of fuel and air are adjusted in relation to the difference between the pressure in the combustion chamber above the mixing bed and the supply pressure of at least one of the combustion components. The fuel-to-air ratio is varied to increase the dome temperature to a predetermined maximum and thereafter tempering of the combustion products is carried out by an increased supply of air to maintain the predetermined dome temperature. When a predetermined desired temperature of combustion products discharged from the heat-storage means occurs, the supply of fuel and air is terminated and thereafter a blast of air is fed into the heat-storage means for heating therein and delivery by the exhaust opening in the wall of the combustion chamber. p The multitude of bodies forming part of the mixing bed is preferably spheroids each having a diameter within the range of 0.5 and 1.0 inch. The carrier for the bodies can be a plate member comprised of ceramic material and having an array of openings to conduct fuel and air into the space between the bodies for mixing and heating therein. The bodies forming the bed may take other forms such as cylinders, berl saddles, etc. The physical parameters of the mixing bed as well as the fuel and air velocities are such that there is no particular requirement for a fluidized bed form of operation. The bodies form a heat-absorptive barrier in the combustion chamber that is particularly absorptive to radiated heat. Preferably, the mixing bed extends horizontally within the refractory walls of the combustion chamber at a spaced location above a bottom wall to define an air and fuel feed chamber containing post members for elevated support of the bed. Fuel and air supply pipes are received in the openings of the side wall of the fuel/air feed chamber. Ignition means, such as a pilot burner, preferably extends in the combustion chamber above the mixing bed.

Figure 2:
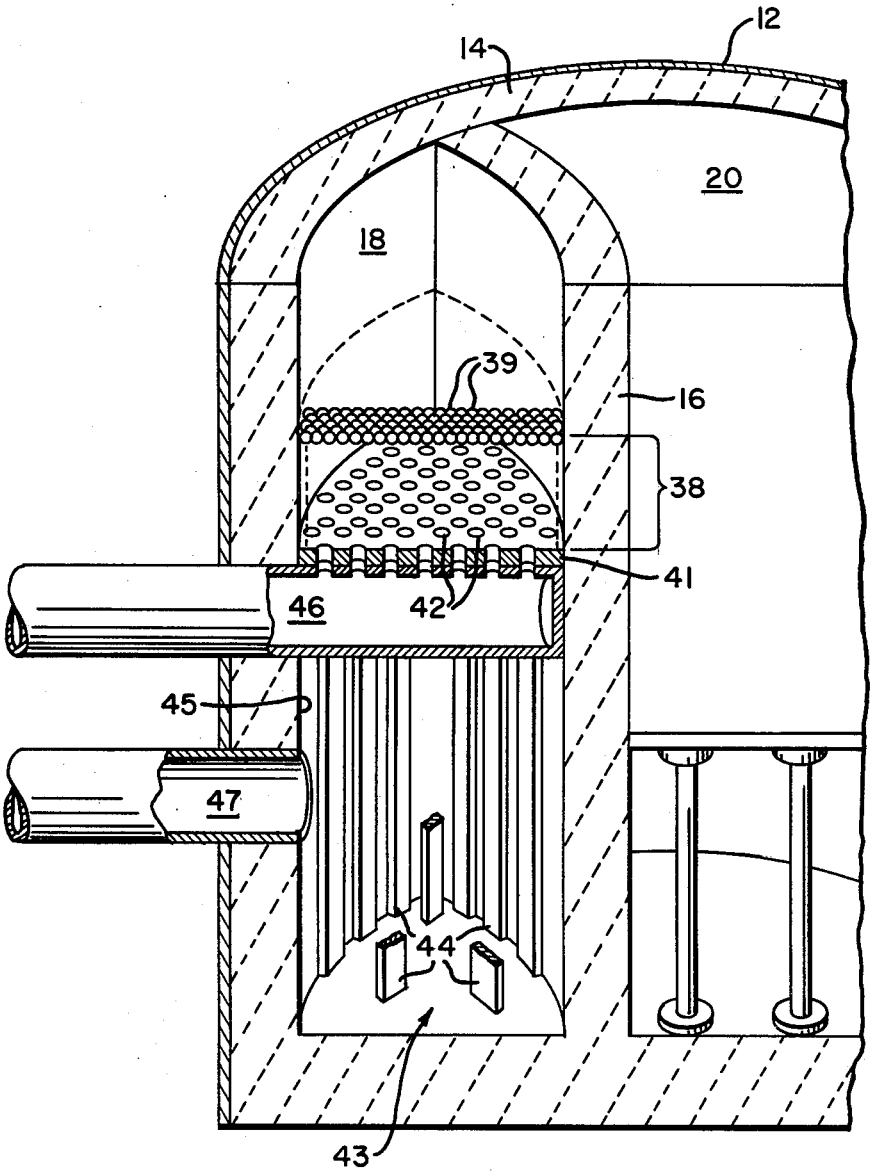

These features and advantages of the present invention as well as others will be more fully understood when the following description of the preferred embodiment of the present invention is read in light of the accompanying drawings, in which:

FIG. 1 is a vertical section through a blast furnace stove and including a schematic illustration of a control system according to the present invention; and FIG. 2 is an enlarged partial isometric view of a mixing bed at the bottom of a combustion chamber for the blast furnace stove shown in FIG. 1.

In FIG. 1, reference numeral 10 identifies a blast furnace stove having an outer cylindrical metal shell 12 supporting an inner lining 14 of refractory material in a manner, per se, well known in the art. A vertical wall 16, sometimes referred to as including a "breast wall" forms a partition of refractory material that separates the internal space in the stove into a combustion chamber 18 and a checker-filled regenerator or heat-storage chamber 20. A dome 21 having an outer metal shell 22 supporting a lining of refractory material 23 forms a top closure for the stove. A gas flow space is formed in the stove by reason of the spaced relation of the top edge of wall 16 from the inner refractory surface of the dome. Hot gases of combustion flow upwardly along the combustion chamber where they pass across the top of wall 16 and then downwardly within the flow spaces in a filling of checkerbrick 24 in the heat-storage chamber. The checkerbrick rests on a steel grid 25 supported by steel columns 26 that rest on the bottom refractory wall of the stove. The columns 26 form a chamber 27 for gases below the checkerbrick 24. When products of combustion pass through the heat-storage chamber, they are exhausted through chamber 27 by a flue pipe 28 having a flow control valve 29 which is open to direct the gases into a flue 30 coupled to a stack 31. The valve 29 is closed and a valve 32 is opened to permit the flow of air from a cold blast main 33 into a conduit pipe communicating with chamber 27. The air blast passes from chamber 27 through the heat-storage chamber within the inner space openings of the checkerbrick where the air is heated. At the top of the heat-storage chamber, the heated blast of air is directed across the top of wall 16 and downwardly along the combustion chamber to a discharge opening 34 in the side wall. The opening is coupled to a pipe 35 having a valve 36 therein that is opened to deliver the heated air blast to a hot blast main 37.

According to the present invention, at the bottom portion of the combustion chamber 18 there is a mixing bed 38 comprised of a multitude of bodies which is shown in the form of spheres 39. The diameters of the spheres forming the mixing bed preferably fall within the range of 0.5 and 1.0 inch but can be 1.24 inches or larger, whereby the inner space between bodies forms an adequate flow space for air and gas to undergo mixing and heating while passing through the bed. The bed extends within the confining walls of the combustion chamber where it is supported on a carrier 41, such as a plate, preferably made of ceramic material, having an array of openings 42 therein to conduct fuel and gas through the plate into the bed. It is to be understood, of course, that while spheres are shown in the drawings to form the bed, other forms of bodies may be used including cylinders of similar dimensions as well as berl saddles. The carrier plate 41 may be formed by a grid structure or by the pipe structure used for fuel distribution. The carrier plate 41 forms a support for the mixing bed that is carried above the flow wall 43 of the combustion chamber by an array of spaced-apart vertical support columns 44 which can be bricks or the like made of ceramic material. The space wherein the support columns 44 extend forms a feed chamber 45 that receives supplies of pressurized fuel and air from pipes 46 and 47, respectively, extending through openings in the side wall 14. In FIG. 2, the pipes 46 and 47 are spaced apart where they communicate with chamber 45 below carrier 41. This construction is for convenience of manufacture since the purpose of bed 38 is to provide mixing of the gases for combustion.

The pipes 46 and 47 have expansion joints 48 and 49, respectively, and blast shutoff valves 51 and 52, respectively. The fuel-supply pipe extends to a header pipe 53 having motor-operated control valves 54 and 55. Air is supplied to pipe 47 from a header pipe 56 having a motor-operated control valve 57 to control the flow of air discharged from a blower 58. The various valve members described thus far are used to control the operation of the blast furnace stove. Other elements used for the control include a pressure transducer 59 in the header pipe 53 to provide a signal in line 61 corresponding to the gas-supply pressure. The signal in line 61 is delivered to a stove controller 62. A pressure transducer 63 in the air-supply header 56 delivers a signal in line 64 to the stove controller 62. A pressure transducer 65 extends through the side wall of the combustion chamber at the top portion thereof to provide a signal in line 66 delivered to the stove controller and corresponding to the pressure of combustion gases in chamber 18 above the mixing bed 38. A thermocouple 67 extends into the dome 21 to provide a signal corresponding to the temperature thereof in line 68 coupled to the stove controller. A thermocouple 69 provides a signal in line 70 corresponding to the temperature of the waste-exhaust gases delivered by flue pipe 28. Line 70 is also coupled to the stove controller 62. The stove controller produces output signals in lines 71, 72 and 73 that are connected to the motor-operated control valves 54, 55 and 57, respectively.

The mixing bed 38 produces uniform and complete mixing of the fuel and air to promote complete and efficient combustion in a minimum amount of combustion space along chamber 18 and with a minimum pressure drop. A pilot burner 74 extends through the side wall of the combustion chamber above the mixing bed to insure reliable ignition. A thermocouple 75 delivers a signal in line 76 to controller 62 corresponding to the temperature of the hot air blast delivered by pipes 35 from the stove. The temperature and pressure signals delivered to the furnace controller are compared and combined to produce control signals in lines 71–73 for operation of the blast furnace stove. In the initial phase of operation, heating of the combustion chamber is carried out in a manner to prevent thermal shock to the refractory of the stove, particularly the combustion chamber. The heating sequence in this phase is designed to assure that the combustion chamber is heated above the ignition temperature to assure stable combustion through the remaining phases of operation at or near stoichiometric ratios of fuel and air and a maximum rate of fuel input. If the temperature of the dome falls below a predetermined minimum, such as occurs for a cold start-up operation, the initial flow rates for fuel and air velocities are established at some predetermined positive excess air ratio, such that a flame front is maintained on or very near the surface of the mixing bed. As the dome temperature increases, represented by the output signal from the thermocouple 67, the fuel and air flows are increased proportionally. The walls of the combustion chamber increase in temperature which is also indicated by the output signal from thermocouple 67 because of an increase in dome temperature. With an increase to the combustion wall temperature approaching the ignition temperature of the fuel and air mixture, the walls of the combustion chamber provide an additional combustion-supporting surface in the direction of the velocity of the gases which, in turn, permits an increase to the fuel and air. When the dome temperature reaches a predetermined minimum temperature that is above the gas and air ignition temperature, the stove controller changes to a second control phase.

In the second control phase, heating of the checkerbrick in the heat-storage chamber is carried out until a maximum predetermined dome temperature is reached. During this phase of operation, a maximum effective fuel-to-air ratio is maintained. The flow of fuel gas and combustion air is maintained proportional, within a finite time span, to the pressure difference between the combustion chamber and the supply pressure of the media for combustion. Thus, the stove controller 62 compares the signal delivered by line 66 from pressure transducer 65 with one or both of the signals fed by lines 61 and 64 corresponding to the gas-supply pressure and air pressure, respectively. During the second phase of operation, a control is initially carried out at a predetermined pressure ratio, for example, the last pressure ratio occurring during the first phase of operation. Thereafter, learning logic may be applied for the continued operation. During the heating operation for the stove checkers, the pressure ratios may be recalled from a locked storage forming a part of the stove controller.

Measurements of the dome temperature are a control basis for this phase during which the dome temperature is increasing, but at a declining rate. The stove controller may incorporate logic circuitry which operates to vary the fuel-to-air ratio slightly in one direction to determine whether the rate of dome temperature change increases in which event a ratio change is again carried out in the same drection and the cycle is repeated until the rate of change decreases. When no improvement to the dome heating rate of change occurs, the last ratio change that shows improvement is stored as a pressure difference control for a control basis to which the system returns. If, on the other hand, the initial ratio change shows a decrease in the dome temperature rate of change, the direction of ratio change is reversed. In this way, adjustments are made to the control system for system variables such as the calorific value and changes to the specific gravity of the fuel, or incorrect pressure set-points. For each stove heating cycle, the control system operates in this same control cycle for a maximum rate of dome temperature change, depending upon the amount of correction control needed during the last heating cycle. When the predetermined maximum dome temperature is reached, a third phase of the control system operates to heat the checkerbrick in the heat-storage chamber without exceeding the maximum predetermined dome temperature until the flue gas exit temperature reaches a preset level. When the maximum predetermined dome temperature occurs at any given instant, a signal by controller 62 is delivered by line 73 to the motor-operated valve 57 to increase the flow of combustion air without a corresponding increase to the flow of fuel. The increase of combustion air tempers the combustion products to the extent sufficient to maintain maximum dome temperature. Control valve 57 may, of course, operate to adjust the air-flow so that the dome temperature remains at its maximum predetermined level. Moreover, the increased flow of combustion air brings about an increase to the flow mass of combustion products through the heat-storage chamber whereby there is an increased heat transfer rate to the checkerbrick. This is greatly advantageous as compared with some control systems that bring about a reduction to the fuel supply to maintain a dome temperature or other systems that reduce both the fuel supply and combustion air to prevent excessive dome temperatures. When the output signal from the thermocouple 69 in line 70 indicates that the exhaust gas temperature has reached some predetermined level which is selected to indicate that the checkerbrick in the heat-storage chamber has been heated to a desired extent, valves 54, 55 and 57 are operated by signals from the stove controller to terminate the flow of combustion air and fuel gas. The blast furnace stove can now be "bottled-up" according to the usual practice which is a standby condition intermediate the heating stage and the blast air stage. In the past and if it is desired, operation of the burner system can be terminated whereby if the stove loses some heat it will not be made up. However, the control system of the present invention can eliminate the bottled-up stage since the time required to change from the heating phase to the blast phase is greatly reduced. The stove can be operated in the heating mode by operating valves 54, 55 and 57 to deliver reduced supplies of fuel and air to the mixing bed for maintaining the desired temperature of the exhaust gases delivered to the flue 30.

When it is desired to heat a blast of air, valves 50, 51, 54, 55 and 57 are closed to terminate the supply of fuel and gas to the air and fuel feed chamber. Valves 32 and 36 are opened to direct the blast of cold air from blast main 33 through the heat-storage compartment and into the ignition chamber where the heated air is discharged through opening 34 into the hot blast main 37. During this phase of operation of the blast furnace stove, the mixing bed forms a thermal barrier against radiating heat within the combustion chamber. The bed then provides a source of heat for fuel and air supplies during their passage through the bed for a succeeding period of combustion. By eliminating the metallic burner housing together with the requirement for a rigid and close-coupled connection of uncompromising form, a cumbersome water-cooled assembly is no longer necessary to isolate the burner from the stove. Moreover, because the controller responds to a change or comparison of a measurement of the pressure in the combustion chamber and a measurement of the fuel gas and/or air, the operation of the blast furnace stove is capable of a very accurate and efficient repeatability. Such a differential pressure measurement will assure nearly identical performance cycles over prolonged periods of operation. Because of the improved stove apparatus, the fuel supply system can be vented to the atmosphere during the air-heating period of operation so that in the event of fuel gas leakage, gas will not accumulate in the confined space or in large quantities. During the time while the fuel gas and air are supplied to the stove for combustion and heating the checkerbrick in the heat-storage chamber, an analysis of oxygen and combustible products delivered by pipe 28 can be used for the basis to adjust the fuel-to-air ratio. The waste gases have a reasonably cold temperature, whereby a reliable analysis is possible.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A vertically-fired blast furnace stove comprising a vertically-extending combustion chamber having a discharge opening for heated air, heat-storage means to receive the products of combustion from said vertically-extending combustion chamber, air-supply means communicating with said heat-storage means for discharging heated air therefrom to said discharge opening, a mixing bed comprised of a multitude of bodies upon a carrier in the bottom portion of said combustion chamber to mix and heat fuel and air supplies for combustion thereabove before passage of combustion products into said heat-storage means, said bodies being comprised of heat-resistant, high-temperature material, said carrier including a grid with openings capable of passing fuel and air into the bed to undergo heating within the bed while passing along the space between the bodies of the bed, and means including control valves to introduce fuel and air directly without combustion into said mixing bed for rapid combustion thereabove in said combustion chamber.

2. The vertically-fired blast furnace stove according to claim 1 wherein said bodies are spheroids each having a diameter within the range of 0.5 and 1.0 inch.

3. The vertically-fired blast furnace stove according to claim 1 or 2 wherein said carrier includes a plate comprised of ceramic material having an array of openings to conduct fuel and air into said mixing bed.

4. The vertically-fired blast furnace stove according to claim 1 further including a refractory lining including a wall between said combustion chamber and said heat-storage means, and dome means to direct products of combustion and heated air across the top edge of said wall at different times in opposite directions.

5. The vertically-fired blast furnace stove according to claim 4 wherein said mixing bed extends horizontally within the refractory walls of said combustion chamber.

6. The vertically-fired blast furnace stove according to claim 5 wherein said means to introduce fuel and air includes pipe means for delivering fuel and air coupled to at least one opening in the refractory wall of the combustion chamber below said mixing bed.

7. The vertically-fired blast furnace stove according to claim 6 wherein said support of said mixing bed includes support posts to space the mixing bed above a bottom wall of said combustion chamber to define an air and fuel feed chamber.

8. The vertically-fired blast furnace stove according to claim 5 wherein said means to introduce fuel and air includes a fuel-delivery pipe and an air-supply pipe coupled to separate openings in the refractory wall of the combustion chamber below said mixing bed.

9. The vertically-fired blast furnace stove according to claim 4 further including means responsive to pressure in said combustion chamber to provide a first signal, means responsive to the pressure of the fuel conducted by said means to introduce to provide a second signal, means responsive to the pressure of the air conducted by said means to introduce to provide a third signal, and control means responsive to a comparison of said first signal with said second and third signals for controlling the supply of fuel and air to said mixing bed.

10. The vertically-fired blast furnace stove according to claim 9 further including control means responsive to the temperature of combustion products directed by said dome into said heat-storage means to vary the supply of air from said means to introduce fuel and air for preventing overheating of said dome by reducing the temperature of said combustion products.

11. The vertically-fired blast furnace stove according to claim 1 further including ignition means communicating with said combustion chamber above said mixing bed.

12. The vertically-fired blast furnace stove according to claim 1 wherein said mixing bed including a carrier includes a multitude of spheroids contained between side walls of said combustion chamber upon an imperforate grid on vertical support walls.

13. A method for controlling a blast furnace stove having a vertically-extending combustion chamber with an exhaust opening for discharging heated air, a heat-storage chamber to receive products of combustion from said combustion chamber, a dome to direct products of combustion from the combustion chamber to the heat-storage chamber, means to deliver air to the heat-storage chamber for heating therein and discharge through said exhaust opening, said method including the steps of passing fuel and air through a mixing bed at the bottom portion of the combustion chamber for admixture therein and combustion in the combustion chamber, increasing the supplies of fuel and air with increases to the dome temperature to heat the combustion chamber above the ignition temperature of the fuel and air mixture up to a predetermined minimum temperature, thereafter adjusting the supplies of fuel and air in relation to the difference between the pressure in the combustion chamber above the mixing bed and the supply pressure of at least one combustion component comprised of the fuel and air, varying the fuel-to-air ratio to increase the dome temperature to a predetermined maximum, thereafter tempering the combustion products with an increased supply of air to maintain said predetermined maximum dome temperature, terminating the supplies of fuel and air to said combustion chamber at a predetermined desired temperature of combustion products discharged from the heat-storage chamber, and thereafter heating a blast of air in the heat-storage chamber for delivery by said exhaust opening.

14. The method according to claim 13 wherein said tempering the combustion products includes increasing the supply of air to said combustion chamber without an increase to the supply of fuel.

15. The method according to claim 13 wherein said terminating the supplies of fuel and air includes using a thermocouple to monitor the exhaust gas temperature.

16. The method according to claim 13 including the step of using a thermocouple to monitor the temperature of said dome.

17. The method according to claim 13 wherein said varying the fuel-to-air ratio includes maintaining the supply of fuel and air to said mixing bed at approximately stoichiometric quantities for complete combustion at a maximum fuel supply rate.

18. The method according to claim 13 wherein said varying the fuel-to-air ratio includes changing the fuel-to-air ratio by monitoring the dome temperature for maximum rate of temperature increases.

19. The method according to claim 13 including the further step of increasing the supply of air to said combustion chamber without an increase to the supply of fuel for increasing the heat transfer rate in said heat-storage chamber during said tempering the combustion products.

* * * * *